United States Patent [19]

Biornstad

[11] 3,993,537

[45] *Nov. 23, 1976

[54] METHOD OF REGULATING A PAPER MACHINE

[75] Inventor: Peter Biornstad, Ravensburg, Germany

[73] Assignee: Escher Wyss G.m.b.H., Ravensburg, Germany

[ * ] Notice: The portion of the term of this patent subsequent to Jan. 27, 1993, has been disclaimed.

[22] Filed: Aug. 23, 1974

[21] Appl. No.: 500,105

[30] Foreign Application Priority Data

Sept. 6, 1973 Switzerland ..... 12801/73

[52] U.S. Cl. ..... 162/198; 162/252; 162/317; 241/33

[51] Int. Cl.[2] ..... D21F 1/06; D21F 11/00

[58] Field of Search ..... 162/198, 254, 253, 252, 162/317; 241/33, 35, 36

[56] References Cited

UNITED STATES PATENTS

| | | | |
|---|---|---|---|
| 2,965,168 | 12/1960 | Beachler | 162/254 |
| 3,005,490 | 10/1961 | Justus | 162/252 |
| 3,631,982 | 1/1972 | Lejeune | 162/340 X |

*Primary Examiner*—Robert L. Lindsay, Jr.
*Assistant Examiner*—George C. Yeung
*Attorney, Agent, or Firm*—Kenyon & Kenyon Reilly Carr & Chapin

[57] ABSTRACT

The pressure at the breast box which is dependent on the dehydration capacity of the stock is measured and a measurement signal obtained which is used to regulate the paper machine. The pressure can be measured from the stock in the breast box, or where the pressure on the underside of the fleece on the suction roll is dependent on the pressure in the box, the pressure on the underside of the fleece can be used to obtain the measurement signal. Various components of the machine can be regulated by the obtained signal to produce a uniform paper.

11 Claims, 5 Drawing Figures

Figure 1:
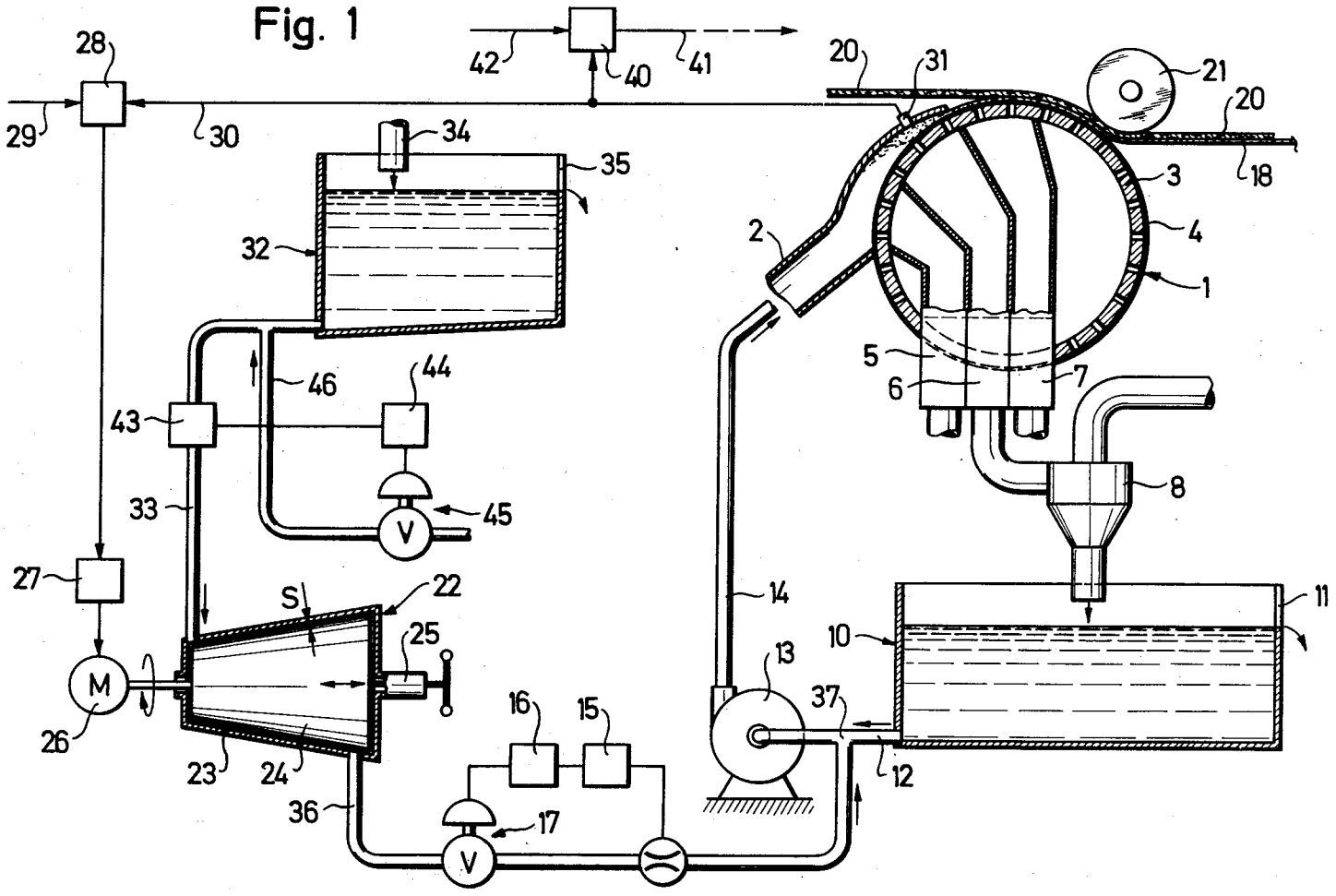

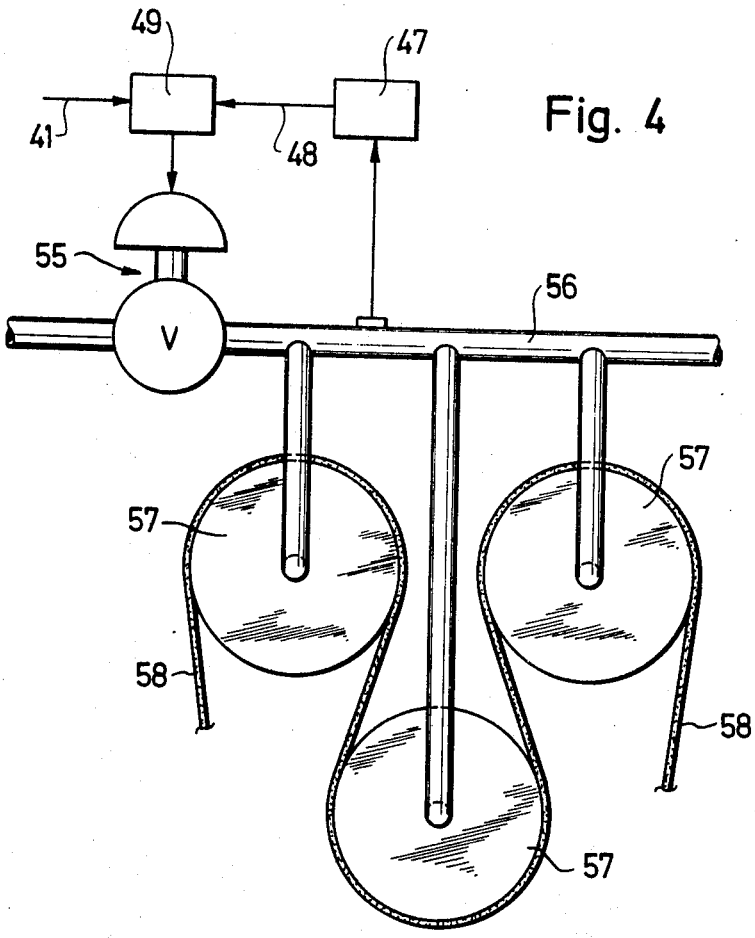
Fig. 4
Fig. 5
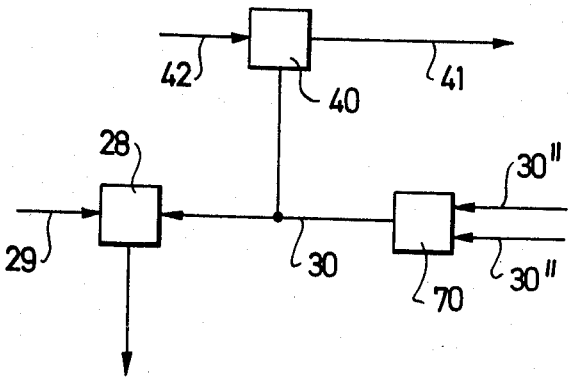

METHOD OF REGULATING A PAPER MACHINE

This invention relates to a method of regulating a paper machine.

Heretofore, in order to adjust the elements or operating values of a paper machine, for example, a refiner of such a machine, intermittent measurement methods have usually been used. These methods include such tests as the Schopper-Riegler test and the Freeness test. However, when using these methods, great difficulty has not only been experienced in extracting a truly representative sample of the stock employed by the paper machines but also in adjusting the operating values of the machine in accordance with the results of such tests. In some instances, considerable skill and experience are required for an adjustment to be made.

In other instances, complicated measurement methods have been used which rely on continuous measurement of the dehydration capacity of the stock. However, the corresponding equipment used with these methods is very sensitive in operation and has not usually been sufficiently reliable despite the complicated construction. As with the intermittent measuring methods, a problem resides in selecting a representative sample.

As is known, the refiners which influence the degree of grinding of the stock, which grinding has a fundamental influence on the dehydration capacity, have been provided with particular regulating means for keeping the degree of grinding constant. For example, where a refiner grinds in a gap between a rotor and a stator, the gap can be varied to obtain a constant input, a constant temperature or a constant pressure of the stock between the inlet and outlet of the refiner. Despite complicated regulating arrangements, it has not been possible to include the wear on the refiner and its effect on the result of the grinding operation. In addition, changes in the quality of the stock which may have an influence, cannot be compensated by the known regulating systems.

Accordingly, it is an object of this invention to regulate a paper machine in a simple reliable manner.

It is another object of the invention to provide a reliable method of regulating the operating values of a paper machine.

It is another object of the invention to regulate a paper machine without having to obtain stock samples.

It is another object of the invention to vary the degree of grinding in a refiner of a paper machine in dependence on changes in the dehydrating capacity of the stock.

Briefly, the invention provides a method of regulating a paper machine having a breast box to which stock is supplied in which a pressure dependent on the dehydration capacity of the stock and taken at the breast box serves as a mesurement signal for the regulation of the machine.

In this way, the difficulties which are, for example connected with the selection of a representative sample of the stock for the measurement with the known paper machines, are avoided. The measuring signal is picked up at that position on the machine where the dehydration capacity is most sensitive, namely, during the formation of the fleece on a screen or wire.

If a constant suction presure is maintained on the underside of the fleece during the formation, for example by means of a suction breast roll as is known, the pressure of the stock in the breast box can serve as the masurement signal. Consequently, a very sensitive measurement of the dehydration capacity of the stock is made possible, since with a sudden increase in the density of the fleece, passage of liquid, i.e. water, from the fleece into the suction roll is obtained and the pressure in the breast rises, and vice versa.

Alternatively, if the pressure on the underside of the fleece being developed in the breast box is regulated in dependence on the pressure of the stock in the breast box, the pressure which is acting on the underside of the fleece may be used as the measurement signal. In this case, it is possible, by adapation of the pressure, e.g. of the vacuum in the suction breast roll, to bridge over a non-operative time which exists between a variation at the refiner and its effect on the breast box.

If the measurement signal is used for influencing the grinding action of a refiner, which precedes the breast box, it is possible to obtain an extremely simple regulation of the sheet formation of the paper machine. It is also possible, in certain circumstances, to dispense with the previous complicated regulations of the refiner. Consequently, where the refiner has a stator and a rotor spaced apart to define a gap for grinding purposes, it is possible, depending on the measurement signal, either to influence the speed of rotation of the rotor or the size of the gap.

In addition to varying the degree of grinding in the refiner, it is also possible to use the measurement signal for influencing dehydration elements such as drying means and presses arranged on the output side of the breast box.

If a machine comprises a plurality of breast boxes, which are fed by way of a common refiner, the measurement signals of the individual breast boxes can be combined and used as a measurement signal for the regulation of the machine.

Figure 2:
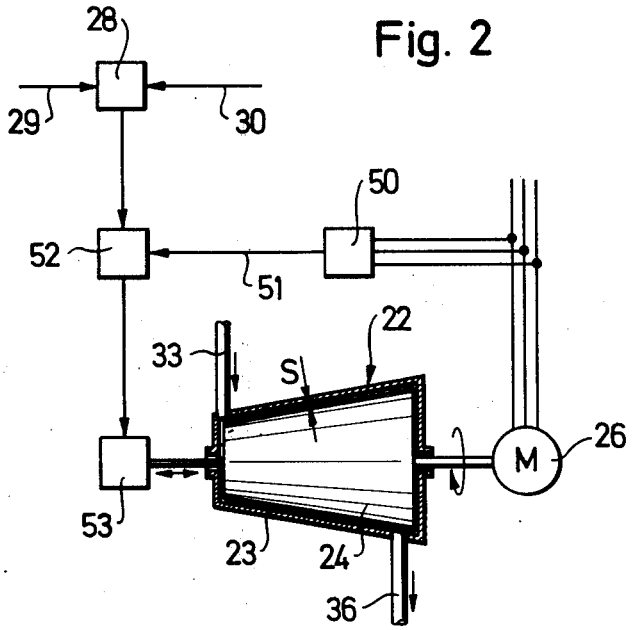
Figure 3:
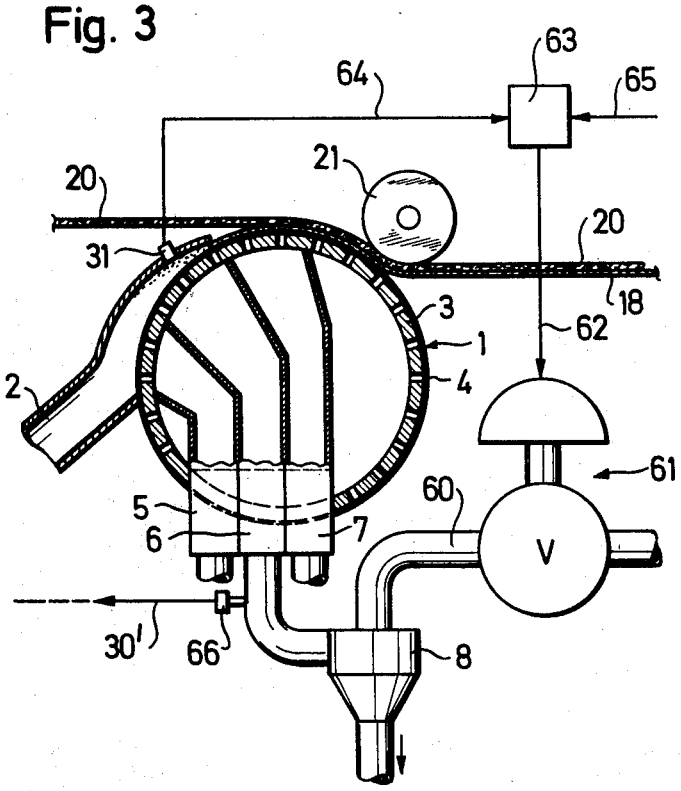

These and other objects and advantages of the invention will become more apparent from the following detailed description and appended claims taken in conjuntion with the accompanying drawings in which:

FIG. 1 diagrammatically illustrates a part of a paper machine having a suction breast roll with a breast box and also a refiner according to the invention;

FIG. 2 illustrates a modified part of the paper machine of FIG. 1 which uses a modified method of influencing the grinding action of the refiner;

FIG. 3 diagrammatically illustrates a suction breast roll with a means for influencing the pressure in the breast box by the vacuum acting in the roll;

FIG. 4 illustrates a means for influencing the heating of drying cylinders depending on the measurement signal of a breast box; and FIG. 5 illustrates a circuit arrangement for combining the measurement signals of a plurality of breast boxes connected to a refiner in accordance with the invention.

Referring to FIG. 1, a paper machine has a suction breast roll 1 associated with a breast box 2 which supplies stock to the roll 1 to form a fleece 18. The suction breast roll 1 contains a hollow roll 3 with a screen 4, which is for example shrunk on to the roll 3. In addition, suction boxes 5, 6, 7 are arranged in the roll 3 to draw liquid, i.e. water from the fleece 18 on the screen 4. These boxes 5, 6, 7 are connected by way of separators 8 for screening water to a vacuum source (not shown) e.g. a vacuum pump. For simplicity in illustration, only one water separator 8 is shown in FIG. 1.

A screened water container 10 is disposed below the water separators 8 to receive the separated water and is provided with an overflow 11 for maintaining a constant liquid level. A pipe conduit 12 leads from the screened water container 10 to a stock feed pump 13 which has a delivery pipe 14 extending into the breast box 2. The fleece 18 which is formed on the screen 4 is lifted off the screen 4 by means of a felt 20 and a pressure-applying roll 21 as are known.

The paper machine also has a refiner 22 for the stock. As shown, the refiner 22 has a stator 23 and a rotor 24 which define a gap S in known manner. In order to vary the size of the gap S and hence the grinding action or the degree of grinding of the stock, the refiner 22 is provided with a gearing 25, by means of which the rotor 24 can, for example, be adjusted manually in an axial direction. Since the stator 23 and the rotor 24 are conical in the usual way, the required modification of the size of the gap S is thereby obtained.

Referring to FIG. 1, the rotor 24 of the refiner 22 is driven by a variable-speed electric motor 26. In order to vary the speed of rotation of the motor 26, a control arrangement 27 having a regulator 28 which has a nominal value 29 is connected to the motor 26. The regulator 28 receives a measurement signal by way of a signal line 30 from a means such as a pressure sensor 31, which is arranged in the breast box 2 to measure the pressure of the stock. The pressure sensor 31 is disposed in the region of the end of the breast box, where the lowest pressure occurs and, as a consequence, variations in this pressure are comparatively most effective.

Stock is supplied to the refiner 22 from a stock chest 32 via a conduit 33 at a concentration of, for example 3.5%. The stock is supplied to the chest 32 by way of a supply pipe 34 and the chest 32 is formed with an overflow 35 to assure that the stock is always fed to the refiner 22 at a constant static pressure.

In order to keep the concentration of the stock constant, a concentration measurement member 43 is arranged in the pipe or conduit 33. This measurement member may operate on the principle of the measurement of shearing forces. The measurement signal of the measuring member 43 is fed to a regulator 44, which influences a valve 45 which is connected into a water pipe 46. Thus, more or less water may be mixed with the stock before reaching the refiner 22.

A conduit 36 extends from the refiner 22 to pass the stock into a mixing position 37 in the pipe 12, where the stock is mixed and diluted with the screened water from the container 10. In order to maintain a constant throughflow quantity, i.e. flow rate, of the stock suspension, a regulating arrangement as known per se, having a flow meter 15, a regulator 16 and a regulating valve 17, is provided in the conduit 36.

With a constant flow rate and concentration of the suspension fed to the breast box 2 and also with a constant vacuum in the suction boxes 5, 6, 7, particularly in the suction box 6, the dehydration capacity of the stock and, consequently, the transmissivity of the fleece 18 formed on the screen 4 influences the pressure of the stock in the breast box 2. As soon as the dehydration capacity falls, the pressure increases, and conversely is reduced with a rising dehydration capacity. Thus, the pressure acts as a measure of the dehydration capacity of the stock.

With the arrangement which is illustrated in FIG. 1, a variation of the pressure in the breast box 2 immediately results in a variation in the degree of grinding of the stock in the refiner. For example, if the pressure which is detected by the sensor 31 increases, thus indicating a reduction in the dehydration capacity and a too fine grinding of the stock, a measurement signal is emitted via line 30 to the regulator 28. The regulator 28 then, after comparing the measurement signal with the nominal value 29, emits a suitable signal to the control arragement 27 and thus to the motor 26 so that the speed of the rotation of the rotor 22 is lowered by the motor 26. Consequently, the necessary adjustment is carried out.

As will also be apparent from FIG. 1, a regulator 40 can be connected to the line 30, which regulator 40 feeds a signal through a line 41 to additional elements of the paper machine. The nominal value of the regulator 40 is represented by 42.

Referring to FIG. 2, wherein like reference characters indicate like parts as above, the degree of grinding in the refiner can be regulated in an alternative way. As shown, the driving motor 26 of the refiner 22 is provided with a measuring instrument 50 for measuring the output of the motor 26. The measuring instrument 50 is, in turn, operative by way of a signal line 51 on a regulator 52, to which is fed the signal of the regulator 28. The regulator 52 is operative on a servomotor 53 for moving the rotor 24 and stator 23 of the refiner 22 relative to each other to adjust the size of the gap S between the stator 23 and rotor 24. The parts 50 to 53 consequently form a secondary control circuit, which is under the influence of regulator 28. In this case, the degree of grinding is not effected by a variation in the speed of rotation of the motor 26, but by a variation in the size of the gap S caused by an axial movement of the rotor 24 in relation to the stator 23.

Referring to FIG. 3, wherein like reference characters indicate like parts as above, a regulating valve 61 is arranged in a vacuum pipe 60 leading from the separator 8. This valve 61 is connected by a signal line 62 to a regulator 63. The regulator 63, in turn, receives the measurement signal of the pressure sensor 31 through a signal line 64 and an nominal value 65. With this arrangement, the vacuum in the suction box 6 is so influenced that, as a result, the pressure measured by the pressure sensor 31 is kept constant, independently of the dehydration capacity of the stock. In this case, the measurement signal of the pressure sensor 31 is not used for regulation, instead the measurement signal of a pressure sensor 66 which is influenced by the pressure operative in the suction box 6 is used. This sensor 31 emits a measurement signal into a line 30′, which can be connected to the regulator 28 in the same manner as the line 30.

Referring to FIG. 4, the measurement signal of the pressure sensor 31 or 36 can alternatively be used to regulate dehydrating elements on an output side of a breast box (not shown) for example, such dehydrating elements as decribed in U.S. Pat. No. 2,965,168. As shown, the signal of the regulator 40 is fed to a regulator 49 through the line 41, which regulator 49 influences a regulating valve 55, which is arranged in a stream pipe 56. The steam pipe 56 serves to supply superheated steam into dehydrating elements in the form of cylinders 57, through which the already dehydrated but still moist paper web 58 is guided. A pressure or temperature sensor 47 is connected downstream of the regulating valve 55 and to the pipe 56 to emit a flow measurement signal to the regulator 49 through a signale line 48.

This arrangement allows the temperature of the superheated steam in the cylinders 57 and hence the heating capacity to be adapted to the requirements which are prescribed by the dehydration capacity of the stock.

Finally, referring to FIG. 5, a plurality of breast boxes can be fed by way of a common refiner (not shown).

In this case, the measurement signals of the individual pressure sensors 31 of the breast boxes are fed by way of signal lines 30'' to a combining unit 70, which can for example be a simple summation unit. The combining unit 70 delivers the signal which is formed into the line 30, where the signal is fed to the regulator 28 as described above. In a similar manner, the signal from the line 30 can also be supplied to the regulator 40 with the output line 41.

Apart from regulating the drying effect of the heating cylinders 57, the present regulating method can also be used for influencing various other dehydration elements, as for example suction boxes and suction zones.

What is claimed is:

1. In a method of regulating a paper machine having a breast box the steps of grinding a stock in a refiner;

thereafter supplying the stock to the breast stock at a constant throughflow quantity as a function of time and at a constant concentration;

measuring the pressure at the breast box as a measure of the dehydration capacity of the stock expelled from the breast box to obtain a measurement signal for regulation of the paper machine; and supplying said signal to the refiner to vary said grinding of the stock.

2. In a method as set forth in claim 1 wherein a constant pressure is maintained on an underside of a fleece being formed in the breast box, said step of measuring includes measuring the pressure of the stock in the breast box to obtain said signal.

3. In a method as set forth in claim 1 wherein a fleece is being formed in the breast box, the further step of regulating a pressure on the underside of the fleece in dependence on the pressure of the stock in the breast box and wherein said step of measuring includes measuring said pressure on the underside of the fleece to obtain said signal.

4. In a method as set forth in claim 1 wherein the refiner includes a rotor for grinding the stock and said signal varies the speed of rotation of the rotor.

5. In a method as set forth in claim 1 wherein the refiner includes a rotor and a stator defining a variable gap therebetween for grinding of the stock, and said signal varies the size of the gap.

6. In a method as set forth in claim 1 wherein the paper machine includes a plurality of the breast boxes and a common refiner for supplying stock to the boxes, the step of obtaining a measurement signal from each box and combining said signals to obtain a combined signal for regulation of the paper machine.

7. A method of regulating a paper machine having at least one breast box and a suction breast roll, said method comprising the steps of grinding a stock in a refiner;

thereafter supplying the stock to each breast box at a constant flow rate and at a constant concentration;

delivering stock from an end of the breast box onto the suction breast roll to form a fleece on the suction breast roll;

subjecting the underside of the fleece on the roll to a suction pressure to withdraw liquid therefrom;

measuring the pressure of the stock in the breast box in a region of the end of the breast box to obtain a measurement signal corresponding to the dehydration capacity of the stock delivered from the breast box for regulation of the paper machine; and supplying said signal to the refiner to vary said grinding of the stock to influence the degree of grinding of the stock.

8. A method of regulating a paper machine having at least one breast box and a suction breast roll, said method comprising the steps of grinding a stock in a refiner;

thereafter supplying the stock to each breast box at a constant flow rate and at a constant concentration;

delivering stock from an end of the breast stock onto the suction breast roll to form a fleece on the suction breast roll;

subjecting the underside of the fleece on the roll to a suction pressure dependent on the pressure of the stock in the breast box to withdraw liquid therefrom;

measuring the pressure on the underside of the fleece to obtain a measurement signal corresponding to the dehydration capacity of the stock delivered from the breast box for regulation of the paper machine; and supplying the signal to the refiner to vary the degree of guiding of the stock.

9. In a method of regulating a paper machine having a breast box and dehydration elements on the breast box for receiving and dehydrating a fleece at a variable rate, the steps of supplying stock to the breast box at a constant throughflow quantity as a function of time and at a constant concentration;

measuring the pressure at the breast box as a measure of the dehydration capacity of the stock expelled from the breast box to obtain a measurement signal; and supplying said signal to the dehydration element to vary said rate.

10. A paper machine comprising a breast box for receiving a supply of stock;

a rotatable suction breast roll positioned at an end of said breast box to receive stock therefrom and to form a fleece thereon;

a refiner for grinding and delivering ground stock to said breast box, said refiner having means for varying the grinding of the stock; and means for measuring the pressure of the stock in said end of said breast box to obtain a measurement signal characteristic of the dehydration capacity of the stock delivered to said roll for regulation of said means in said refiner.

11. A paper machine as set forth in claim 10 wherein said means is a pressure sensor positioned on said breast box.

* * * * *

UNITED STATES PATENT AND TRADEMARK OFFICE

CERTIFICATE OF CORRECTION

PATENT NO. : 3,993,537

DATED : November 23, 1976

INVENTOR(S) : Peter Biornstad

It is certified that error appears in the above-identified patent and that said Letters Patent are hereby corrected as shown below:

Column 2, line 13, "adapation" should be --adaptation--.
Column 4, line 11, "arragement" should be --arrangement--.
Column 4, line 12, delete "the"(second occurrence).
Column 4, line 33, insert "the" after --of--.
Column 4, line 44, "an" should be --a--.
Column 4, line 60, "decribed" should be --described--.
Column 5, line 3, "signale" should be --signal--.
Column 6, line 37, after "on" insert --an output side of--.

Signed and Sealed this

Fifteenth Day of February 1977

[SEAL]

*Attest:*

RUTH C. MASON
*Attesting Officer*

C. MARSHALL DANN
*Commissioner of Patents and Trademarks*